United States Patent [19]

Hacker et al.

[11] 4,109,252

[45] Aug. 22, 1978

[54] ANTENNA MOUNT ATTACHED TO VEHICLE TRUNK INTERIOR

[75] Inventors: Morris Hacker, Bayside; Dominick Padilla, Bronx, both of N.Y.

[73] Assignee: RMS Electronics, Inc., Bronx, N.Y.

[21] Appl. No.: 714,575

[22] Filed: Aug. 16, 1976

[51] Int. Cl.[2] ..... H01Q 1/32

[52] U.S. Cl. ..... 343/715; 248/539

[58] Field of Search ..... 343/713, 715; 248/539

[56] References Cited

U.S. PATENT DOCUMENTS

| | | | |
|---|---|---|---|
| 3,071,338 | 1/1963 | Kaufman et al. | 343/713 |
| 4,028,705 | 6/1977 | Loyd | 343/715 |

OTHER PUBLICATIONS

Flip Flop Advertisement Placed in Files 7/30/76.

*Primary Examiner*—Eli Lieberman

*Attorney, Agent, or Firm*—Hubbell, Cohen, Stiefel & Gross

[57] ABSTRACT

An antenna mount to be received within the trunk of an automobile, truck or other vehicle, comprising a bracket member adapted to be secured to the trunk rain channel and incorporating a generally vertically disposed mounting flange, a mounting member adapted to extend outside of the trunk and having a support section to be secured to the mounting flange of the bracket, aligned rib and groove elements on the respective bracket and mounting members, and a wing nut - bolt assembly adapted to releasably secure the mounting and bracket members to one another with the respective rib and groove elements in engagement so as to prevent relative movement therebetween and maintain the integrity of the composite mount. When it is desired to remove the antenna from the vehicle loosening of the wing nut facilitates disassembly of the mount and stowage of the antenna within the trunk, thereby minimizing the risk of theft.

4 Claims, 5 Drawing Figures

ANTENNA MOUNT ATTACHED TO VEHICLE TRUNK INTERIOR

This invention relates to a mount for a CB radio antenna or the like, and more particularly to such an antenna mount which may be received within the trunk of a car, truck or other vehicle and readily assembled for use, or disassembled and the antenna stowed within the trunk to discourage theft.

BACKGROUND OF THE INVENTION

Antenna mounts for removing or retracting antennas on moving vehicles are well known. Such devices are disclosed, for example, in Yerger U.S. Pat. No. 2,367,164, Rowe U.S. Pat. No. 3,208,702 and Ivy Pat. No. 3,357,663. More recently, there has been substantial interest in removable or retractable antenna mounts for auto- or truck-mounted CB radio antennas. With the markedly increased popularity of CB radios, there has been a corresponding increase in thefts. Since the identification of a CB antenna on an automobile or truck may serve as an invitation to theft, a number of trunk-mounted removable or retractable mounts for CB antennas have recently been developed.

One such CB antenna mount which has recently been proposed comprises a bracket mounted on the rain channel of the vehicle trunk, hingedly secured to the antenna mount. When in use, the antenna mount supports the antenna outside of the vehicle trunk, the mount extending beneath the closed trunk lid and into the interior of the trunk. When not in use, the hinged mount is pivoted into the vehicle trunk to conceal the antenna from view. One disadvantage of this form of device, however, is that it impairs the access to and storage room within the vehicle trunk.

Another form of stowable CB antenna mount comprises a pair of separable bracket elements, the first of which is mounted in one of the rear corners of the trunk lid receptacle and defines a pair of receiving sleeves, and the second of which supports the antenna and defines inserts slidably receivable within such sleeves. In this form of mount the support element may be disengaged from the mounting bracket and the antenna stowed in any manner within the trunk or elsewhere. This device may, however, only be mounted in restricted areas in which there is sufficient room for mounting and engaging the respective sleeve and insert members. Moreover, it does not prevent both lateral and longitudinal movement of the separable elements thereof and does not, therefore, insure the desired structural integrity for such a device.

It is, accordingly, among the objects of the present invention to provide an improved antenna mount to be received within the trunk of an automobile, truck or other vehicle, which is simply constructed, easy to mount, strong and durable, and which does not impair access to or space within the vehicle trunk.

Other objects and advantages of the antenna mount of the invention will appear from the following description of a preferred embodiment thereof.

SUMMARY OF THE INVENTION

In accordance with the present invention we have developed an antenna mount to be received within the trunk of a vehicle, comprising a bracket member having a mounting flange adapted to be secured to the rain channel of the vehicle trunk and a second mounting flange adapted to be generally vertically disposed and having at least one rib and groove element extending longitudinally thereof; a mounting member adapted to extend from outside of the vehicle, beneath the closed trunk lid and inside the trunk, and comprising a first, mount section for mounting an antenna outside the vehicle, and a second, support section having at least one further rib or groove element extending longitudinally thereof and adapted to be generally vertically disposed within the vehicle trunk and aligned with the rib or groove element on the bracket member; and a nut and bolt assembly for releasably securing the mounting member to the bracket member, the bolt extending through the second mounting flange of the bracket member and the support section of the mounting member, and the rib and groove elements on the respective members engaging one another and thereby preventing both longitudinal and lateral movement of the respective components relative to one another when the assembly is so disposed as to mount an antenna to the vehicle.

By thus defining the antenna mount by two entirely separable bracket and mounting members the latter, having the antenna mounted thereto, may be readily separated and stowed in the vehicle trunk in any desired manner or disposition. Moreover, by providing the bracket member with a first flange for mounting to the trunk rain channel and a depending second flange for supporting, in turn, the mounting member, the antenna mount may be secured at any point on the rain channels along the sides of the vehicle trunk, not merely in the upper corners thereof. Further, by employing the engaging rib and groove elements and nut and bolt means, the bracket and mounting members define an integral structure which has excellent structural integrity, which is subject to neither longitudinal nor lateral relative movement, and yet which may be readily disassembled.

THE PREFERRED EMBODIMENT OF THE INVENTION

Figure 1:
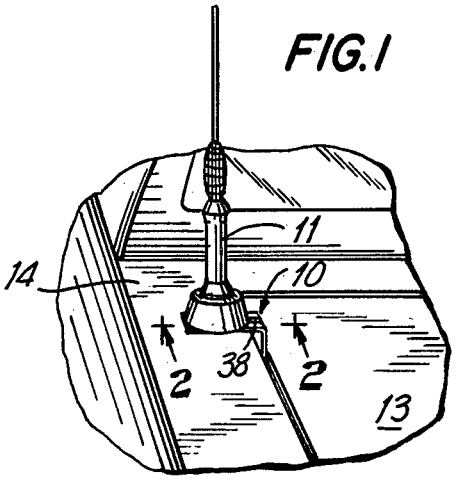
FIG. 1 is a perspective view showing a CB antenna disposed on the rear deck of an automobile, mounted adjacent the closed lid of the vehicle trunk on a preferred embodiment of the antenna mount of the present invention.
Figure 2:
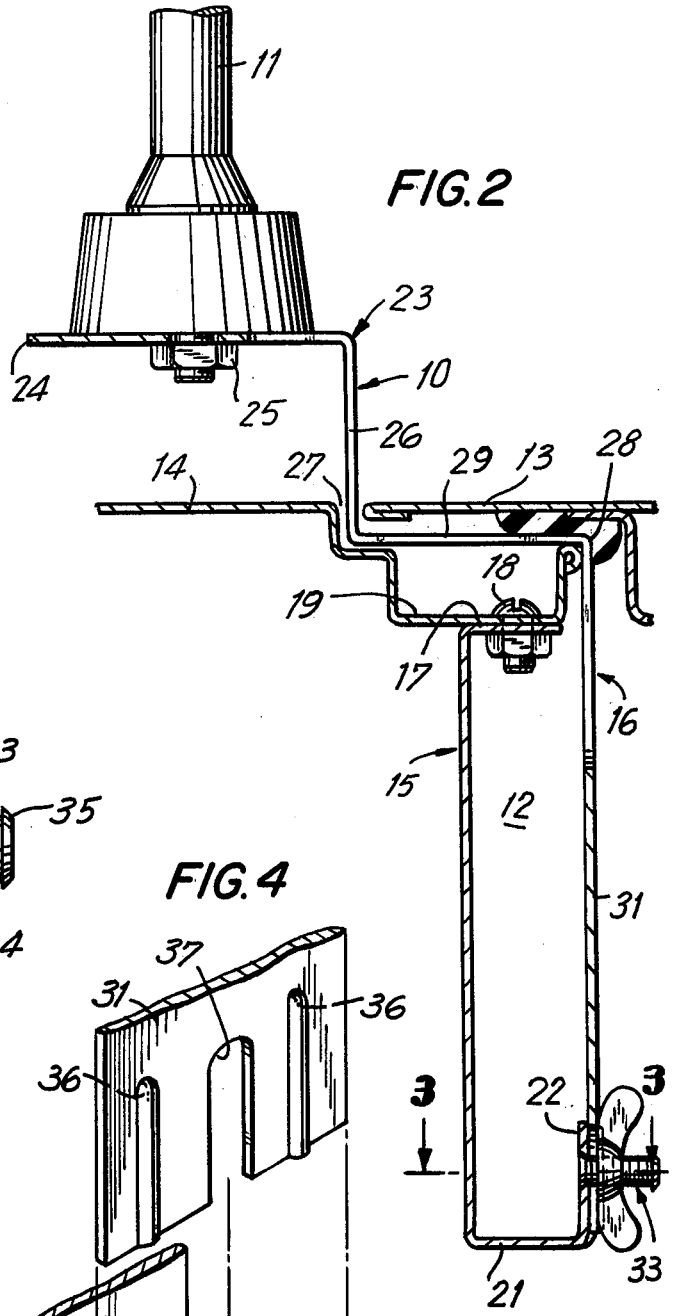
FIG. 2 is a vertical section through a portion of the antenna and mount shown in FIG. 1, taken along the line 2—2 in FIG. 1.
Figure 5:
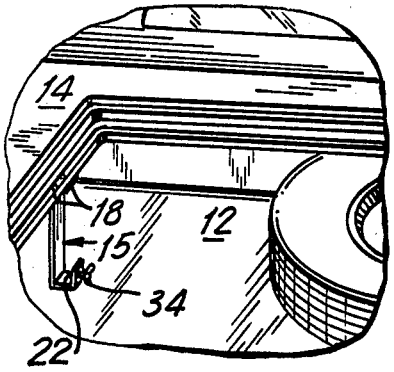
FIG. 5 is a partial perspective view of the interior of a vehicle trunk, showing the bracket member of the antenna mount secured to the trunk rain channel, the mounting member and the antenna mounted thereto having been disassembled therefrom for stowage.

The various advantages of the antenna mount of the invention will become more fully apparent from consideration of the preferred embodiment shown in the accompanying drawing, wherein a mount 10 for a CB antenna 11 is illustrated. As shown in FIGS. 1, 2 and 5, the antenna mount is adapted to be disposed within the trunk 12 of a vehicle, the mount extending above the trunk lid 13 and the rear deck 14 of the vehicle when in use.

As best shown in FIG. 2, the antenna mount 10 comprises two principle components, viz., a bracket member 15 to be received within the trunk 12, and a mounting member 16 to extend from outside of the vehicle, beneath the closed lid 13 of the trunk and inside the trunk. As indicated hereinafter, these two separable members define a composite assembly having great structural integrity and yet being readily disassembled to facilitate removal and stowage of the antenna in any desired location within the vehicle trunk.

Bracket member 15 has a generally U-shaped cross-section, one leg 17 of the U defining a first mounting flange adapted to be generally horizontally disposed and secured, as by nuts and bolts 18, to a rain channel 19 of the trunk. The opposite leg 21 of bracket member 15 is parallel with leg 17 and integral with and supports a second mounting flange 22 adapted to be generally vertically disposed and defining the support for mounting member 16.

The mounting member comprises a first, mount section 23 having a generally L-shaped cross-section. A first leg 24 of the mount section 23 is adapted to extend substantially horizontally outside of the vehicle for mounting the antenna 11, as by nut and bolt 25, thereto. The second leg 26 of the mount section is adapted to extend substantially vertically into aperture 27 between the deck 14 and trunk lid 13. Mounting member 16 further incorporates a second, support section 28 which, similarly, has a generally L-shaped cross-section, one leg 29 of which is adapted to extend substantially horizontally beneath the closed trunk lid 13 and the second leg 31 of which is adapted to extend substantially vertically into the trunk 12.

Figure 3:
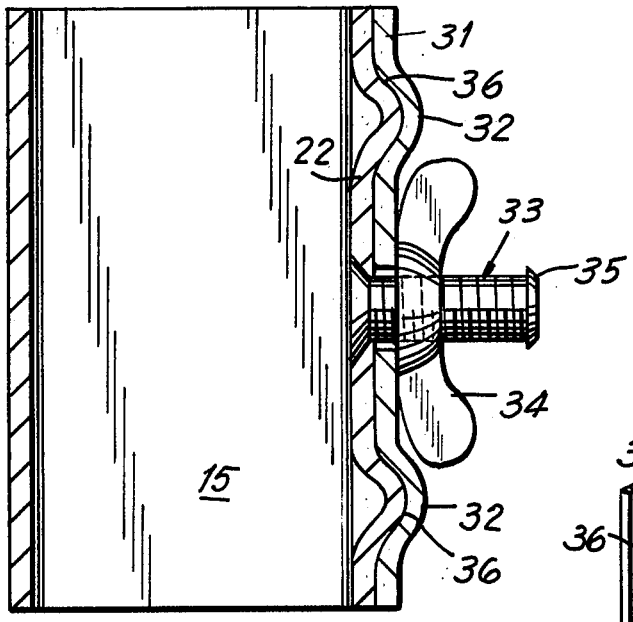
FIG. 3 is a horizontal section through the bolt and wing nut assembly which secures the bracket and mounting member components of the antenna mount, viewed in the direction of line 3—3 in FIG. 2.
Figure 4:
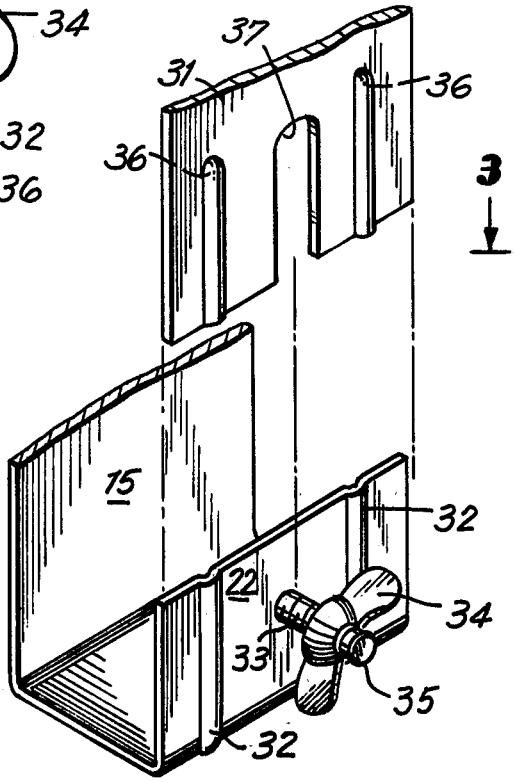
FIG. 4 is a partial perspective view illustrating the manner of engagement between the mounting flange and the support section of the bracket and mounting members of the antenna mount.

As best shown in FIGS. 3 and 4, the second mounting flange 22 of bracket member 15 has a pair of protrusions or ribs 32 extending longitudinally thereof. A threaded bolt 33 is also mounted to the flange 22, as by being spot-welded thereto. A wing nut 34 is threaded on bolt 33; preferably the end of the bolt is peened as at 35 to maintain wing nut 34 thereon even after disassembly of the composite antenna mount.

The depending leg 31 of the mounting member 16 is provided with a pair of indentations or grooves 36 adapted to be aligned with the corresponding ribs 32 on the mounting flange 22 of bracket member 15. An elongated slot 37 is further provided in leg 31 extending longitudinally thereof, intermediate and substantially parallel to the grooves 36 formed therein. A further groove 38 (see FIG. 1) may also be provided in legs 29 and 31 of the mounting member for tracing the antenna lead therethrough.

When it is desired to mount antenna 11 within the trunk 12 of a vehicle, the bracket member 15 is initially mounted at any desired point of the rain channel 19 of the trunk as by drilling appropriate holes therethrough and securing the brackets by bolts 18 (see FIG. 5). The antenna is then bolted at 25 to leg 24 of the mounting member 16. The mounting member is then secured in assembled relation with bracket member 15, merely by moving leg 31 of the mounting member into engagement with the mounting flange 22 of the bracket member, bolt 33 in the latter being received within slot 37 and the aligned ribs 32 and grooves 36 engaging one another. Wing nut 34 is thereafter tightened, the frictional engagement between the surfaces of the mounting flange 22 and the support section 28, and particularly between the mating ribs 32 and grooves 36, insuring the integrity of the antenna mount assembly and preventing both longitudinal and lateral movement of the respective members thereof relative to one another. When trunk lid 13 is thereafter closed, a stable, secure antenna mount is thus provided.

When it is desired to dismount the antenna and thereby minimize any invitation to possible theft, the trunk lid is simply opened, wing nut 34 loosened, and mounting member 16 and antenna 11 removed from the assembly and stowed in any desired location within trunk 12. The antenna is thus both concealed from sight and may be stowed in any desired manner without impairing either access to or the capacity of the vehicle trunk.

It will be understood that various changes may be made in the preferred embodiment described hereinabove without departing from the scope of the present invention. Thus, the ribs 32 and grooves 36 may be interchanged on the bracket member 15 and mounting member 16 of the composite assembly, or the number of pairs of mating ribs and grooves may be varied. Similarly, if desired, and dependent upon the configuration of the particular vehicle, the orientation of the respective elements of the composite mount may be modified. Since these or other variations are within the scope of our invention, it is intended that the preceding description should be construed as illustrative and not in a limiting sense.

What is claimed is:

1. An antenna mount, which comprises:

(a) a bracket member to be received within the trunk of a vehicle and having a first mounting flange adapted to be secured to the rain channel of the trunk and a second mounting flange integral therewith adapted to be generally vertically disposed and having at least one rib or groove element extending longitudinally thereof;

(b) a separable mounting member to extend from outside of the vehicle, beneath the closed lid of the vehicle trunk and inside the trunk, and comprising a first, mount section for mounting an antenna outside of the vehicle, and a second, support section having at least one rib or groove element extending longitudinally thereof and adapted to be generally vertically disposed within the vehicle trunk and aligned with the rib or groove element on the bracket member;

(c) bolt means extending through the second mounting flange of the bracket member and the support section of the mounting member; and (d) nut means for engaging the bolt means and releasably securing the mounting member to the bracket member with the rib and groove elements on the respective mounting flange and support sections thereof engaging one another and thereby preventing both longitudinal and lateral movement of said members relative to one another when the antenna mount is disposed to mount an antenna to the vehicle.

2. The antenna mount of claim 1, wherein the bracket member has a generally U-shaped cross-section, one leg of the U defining the first mounting flange adapted to be generally horizontally disposed and secured to the rain channel of the vehicle trunk, and the opposite leg thereof being integral with and supporting the second mounting flange thereof;

wherein the mount section of the mounting member has a generally L-shaped cross-section, one leg of the L being adapted to extend substantially horizontally outside of the vehicle for mounting an antenna thereto and the other leg being adapted to extend substantially vertically into the aperture between the vehicle deck and lid; and wherein the support section of the mounting member has a generally L-shaped cross-section, one leg of the L being adapted to extend substantially horizontally beneath the closed trunk lid and the other leg being adapted to extend substantially vertically into the vehicle trunk.

3. The antenna mount of claim 1, wherein the support section of the mounting member has an elongated slot extending longitudinally thereof substantially parallel to the rib or groove element thereof, in which the bolt means is permanently mounted to the mounting flange of the bracket member and extends through the slot in the support section of the mounting member; and in which the nut means is a wing nut threadingly engaging the bolt means to releasably secure the mounting member to the bracket member as aforesaid.

4. The antenna mount of claim 3, wherein the free end of the bolt means is peened to maintain the wing nut thereon notwithstanding disassembly of the mounting member from the bracket member of the antenna mount.

* * * * *